US006631566B2

(12) United States Patent
Ross et al.

(10) Patent No.: US 6,631,566 B2
(45) Date of Patent: Oct. 14, 2003

(54) METHOD OF DRYING A WEB

(75) Inventors: Russell F. Ross, Lilburn, GA (US); Jack C. Lau, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/954,487

(22) Filed: Sep. 17, 2001

(65) Prior Publication Data

US 2002/0069551 A1 Jun. 13, 2002

Related U.S. Application Data

(60) Provisional application No. 60/233,601, filed on Sep. 18, 2000.

(51) Int. Cl.[7] ..... F26B 3/00
(52) U.S. Cl. ..... 34/445; 34/446; 34/451
(58) Field of Search ..... 34/445, 446, 451, 34/471, 467

(56) References Cited

U.S. PATENT DOCUMENTS

| | | | | |
|---|---|---|---|---|
| 2,879,607 A | | 3/1959 | Fleissner et al. | |
| 3,284,920 A | | 11/1966 | Hayrinen et al. | |
| 3,362,079 A | * | 1/1968 | Fleissner | 34/23 |
| 3,377,056 A | | 4/1968 | Boye | |
| 3,432,936 A | | 3/1969 | Cole et al. | |
| 3,668,785 A | | 6/1972 | Rodwin | |
| 3,849,904 A | | 11/1974 | Villalobos | |
| 3,864,842 A | * | 2/1975 | Sawyer | 34/41 |
| 4,074,441 A | | 2/1978 | Helversen et al. | |
| 4,462,868 A | * | 7/1984 | Oubridge et al. | 162/280 |
| 4,523,390 A | | 6/1985 | McCarthy | |
| 5,126,015 A | * | 6/1992 | Pounder | 162/206 |
| 5,255,447 A | | 10/1993 | Christ | |
| 5,416,979 A | | 5/1995 | Joiner | |
| 5,425,852 A | | 6/1995 | Joiner | |
| 5,465,504 A | * | 11/1995 | Joiner | 34/446 |
| 5,492,598 A | | 2/1996 | Hermans et al. | |
| 5,569,359 A | * | 10/1996 | Joiner | 162/206 |
| 5,581,906 A | | 12/1996 | Ensign et al. | |
| 5,694,702 A | * | 12/1997 | Anderson | 34/446 |
| 5,784,804 A | | 7/1998 | Nowakowski | |
| 5,937,538 A | * | 8/1999 | Joiner | 34/122 |
| 5,974,691 A | * | 11/1999 | Marchal | 34/456 |
| 5,983,523 A | * | 11/1999 | Ijas et al. | 34/445 |
| 6,014,818 A | * | 1/2000 | Kristrom | 34/273 |
| 6,017,417 A | | 1/2000 | Wendt et al. | |
| 6,049,998 A | * | 4/2000 | Crouse et al. | 34/445 |
| 6,149,767 A | | 11/2000 | Hermans et al. | |
| 6,154,981 A | * | 12/2000 | Heikkila et al. | 34/451 |
| 6,168,743 B1 | * | 1/2001 | Reese et al. | 264/345 |
| 6,207,020 B1 | * | 3/2001 | Anderson | 162/207 |
| 6,282,811 B1 | * | 9/2001 | Voth | 34/417 |
| 6,331,230 B1 | | 12/2001 | Hermans et al. | |

FOREIGN PATENT DOCUMENTS

| | | |
|---|---|---|
| EP | 0874083 A1 | 10/1998 |
| WO | WO 9957367 A1 | 11/1999 |

OTHER PUBLICATIONS

Int'l Search Report Dated Jul. 2, 2002.

* cited by examiner

*Primary Examiner*—Ira S. Lazarus
*Assistant Examiner*—K. B Rinehart
(74) *Attorney, Agent, or Firm*—Dority & Manning, P.A.

(57) ABSTRACT

A method of drying a paper web is provided. The method utilizes a dryer, such as a through-dryer, having a first dryer section and a second dryer section. Within the first dryer section, a relatively wet paper web is dried at an elevated temperature, such as between about 400° F. to about 500° F. After being dried by the first dryer section, the web is relatively dry and is further dried by the second dryer section at a reduced temperature, such as between about 300° F. to about 400° F. A variety of control techniques can also be utilized to control the temperature of each dryer section.

39 Claims, 5 Drawing Sheets

METHOD OF DRYING A WEB

RELATED APPLICATION

The present application claims priority to a provisional application filed on Sep. 18, 2000 having Ser. No. 60/233,601.

BACKGROUND OF THE INVENTION

Paper webs are commonly dried using a drying apparatus, such as a through-dryer. For example, through-dryers typically operate by contacting heated air with a paper web while the web is supported by a wire or other papermaking fabric. The heated air dries the web as it is transported around a rotating drum. However, one problem associated with conventional methods of drying paper webs with such dryers is that, due to the wetness of the web, the dryers are relatively inefficient and have a low production capacity. The webs are also susceptible to heat-related degradation, which can create various malodorous compounds.

As such, a need currently exists for an improved method of drying a paper web. In particular, a need currently exists for an improved method of drying a paper web that allows the dryer to have an increased production capacity without having a substantially adverse affect on product quality.

SUMMARY OF THE INVENTION

The present invention is directed to a method of drying a paper web. In particular, the present invention is directed to a method of providing temperature control of a paper web as it traverses through a through-dryer. For instance, in one embodiment, a paper web is first dried within a first dryer section at an elevated temperature and subsequently dried within a second dryer section at a reduced temperature.

The method of the present invention can generally be utilized with various dryers used in drying paper webs. For instance, a through-dryer can be provided with two dryer sections in accordance with the present invention. A "relatively wet" paper web is initially provided to a first dryer section to be dried. As used herein, the phrase "relatively wet" generally refers to paper webs having a low solids consistency. For instance, a web may be supplied to the first dryer section at a consistency of less than about 60% (% solids consistency), particularly between about 15% to about 45%, and more particularly between about 20% to about 40%. As the web is moved through the first dryer section, it is partially dried.

From the first dryer section, the web then enters a second dryer section for further drying. In general, the web entering the second dryer section is "relatively dry". As used herein, the phrase "relatively dry" generally refers to paper webs having a higher solids consistency than a "relatively wet" web. For example, "relatively wet" webs having consistencies within the above-mentioned ranges can be dried to consistencies of greater than about 25% (% solids consistency), particularly greater than about 35%, and more particularly between about 45% to about 70%, within the first dryer section to result in a "relatively dry" web. Although the exemplary ranges mentioned above for "relatively dry" webs and "relatively wet" webs are overlapping, such webs should generally be interpreted to have different consistencies. For instance, in some instances, a "relatively wet" web may have a consistency of about 35%. In such cases, a "relatively dry" web would accordingly have a consistency of greater than about 35%. It should also be understood that, at any given point of a continuous through-drying process, the solids consistency of a web passing therethrough is generally greater than the solids consistency of the web at any previous point of the process.

In accordance with the present invention, the temperatures within the first dryer section and the second dryer section can be selectively controlled to improve the overall capacity of the drying operation. In one embodiment, for example, an elevated temperature can be provided to the first dryer section when the web is relatively wet and a reduced temperature, in comparison to the elevated temperature, can be provided to the second dryer section when the web is relatively dry. For instance, in one embodiment, a temperature between about 400° F. to about 500° F., and particularly between about 450° F. to about 500° F., is provided to the first dryer section, while a temperature between about 300° F. to about 400° F., and particularly between about 300° F. to about 350° F., is provided to the second dryer section.

Generally, the provision of an elevated temperature to the first dryer section does not cause the temperature of the web to be increased significantly above its "thermal degradation temperature". As used herein, the "thermal degradation temperature" generally refers to the temperature at which a component (e.g., fiber, lignin, additives, etc.) of a paper web begins to chemically degrade and generate malodorous compounds, as is well known in the art. In particular, when the web is relatively wet, the heated air does not easily pass between the fibers within the web. Instead, most of the heated air flows parallel to the surface of the web and raises the temperature of the web until it reaches the saturation temperature of air for a given humidity, temperature, and pressure. Once the saturation temperature is attained, the heated air then begins to significantly evaporate moisture contained within the web. Accordingly, because the temperature of the relatively wet web is not significantly increased above the saturation temperature of the air when dried at an elevated temperature, the temperature of the web within the first through-dryer section can usually remain less than the "thermal degradation temperature" of the web.

Heat can be supplied to the first dryer section and the second dryer section using a variety of methods and/or techniques. For instance, in some embodiments, a first air channel can supply air at an elevated temperature to the first dryer section, and a second air channel can supply air at a reduced temperature to the second dryer section. The temperature within each air channel may be controlled using a variety of techniques, such as, but not limited to, burners, valves, cooling units, other streams of air, and the like.

Moreover, in some embodiments, a single air channel can supply air to each dryer section. When utilizing a single air channel, the air is typically heated to a certain temperature and then distributed to the dryer sections. For instance, in one embodiment, the air within a single air supply channel is heated to an elevated temperature and distributed to the first dryer section. However, when distributing the heated air to the second dryer section, the temperature of the heated supply air can be lowered to a reduced temperature using a variety of control techniques, such as, but not limited to, a stream of supplemental or recycled air, a cooling unit, etc. Moreover, in some instances, such as when utilizing a stream of air to cool the heated supply air, the reduced temperature can actually vary at different points within the second dryer section. For example, a stream of cool air can be combined with the heated supply air within the second dryer section such that the temperature of the web gradually decreases as it moves through the second dryer section.

In another embodiment, the air within a single air supply channel is heated to a reduced temperature and distributed to the second dryer section. However, when distributing the air to the first dryer section, the temperature of the air can be increased to an elevated temperature using a variety of control techniques, such as, but not limited to, supplemental heated air or a burner. For example, when utilizing a burner, the elevated temperature can be relatively constant. Moreover, in some instances, such as when utilizing a stream of air to heat the supply air, the elevated temperature can actually vary at different points within the first dryer section. For example, a stream of heated air can be combined with the supply air within the first dryer section such that the temperature of the web gradually decreases as it moves through the first dryer section.

Other features and aspects of the present invention are discussed in greater detail below.

BRIEF DESCRIPTION OF THE DRAWING

A full and enabling disclosure of the present invention, including the best mode thereof, directed to one of ordinary skill in the art, is set forth in the specification, which makes reference to the appended drawings, in which.

Figure 1:
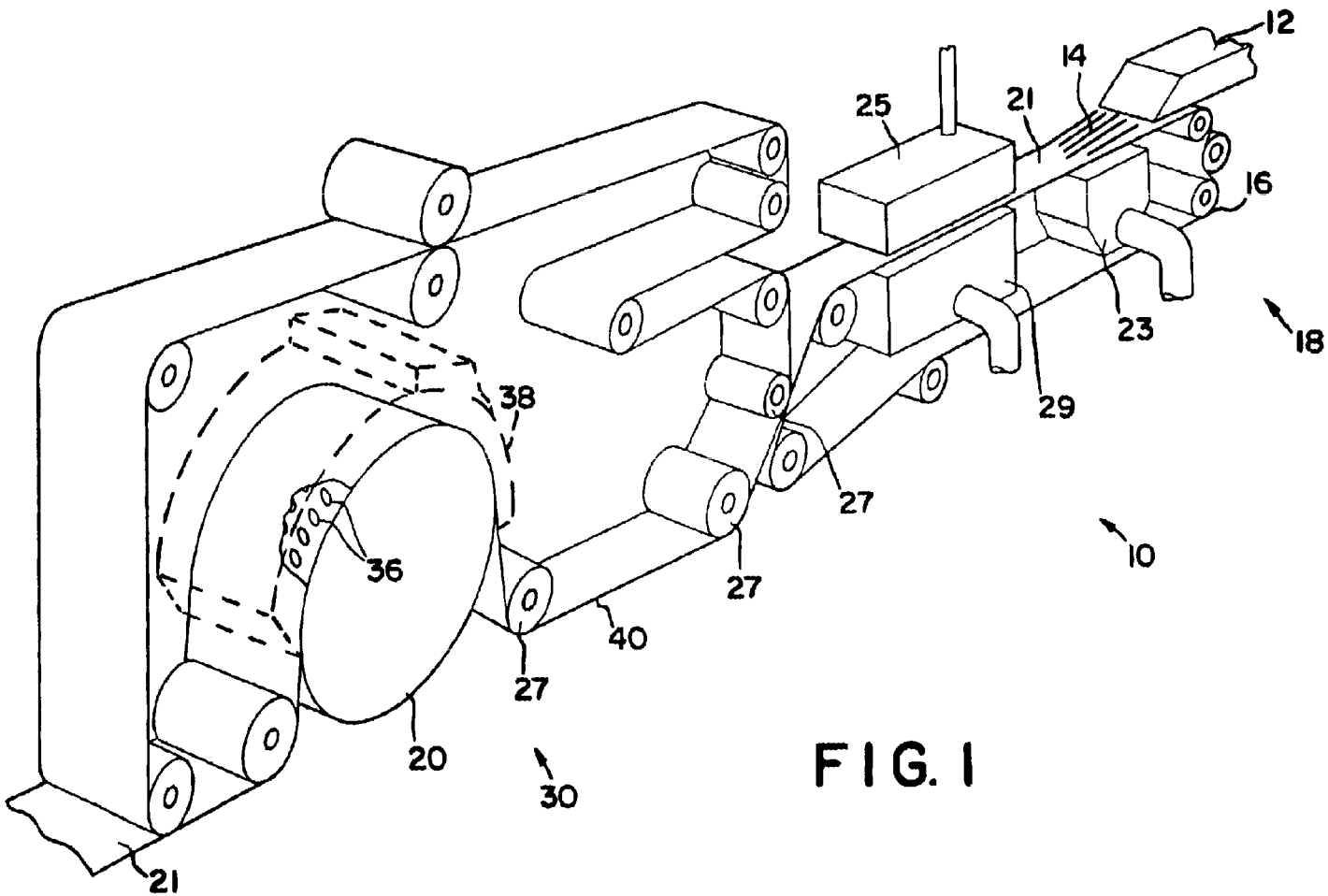
FIG. 1 is an illustration of one embodiment of a papermaking process that can be utilized in accordance with the present invention.

Repeat use of reference characters in the present specification and drawings is intended to represent the same or analogous features or elements of the invention.

DETAILED DESCRIPTION OF REPRESENTATIVE EMBODIMENT

Reference now will be made in detail to various embodiments of the invention, one or more examples of which are set forth below. Each example is provided by way of explanation, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a method of controlling the temperature of a paper web during drying. For instance, in one embodiment of the present invention, a paper web is passed through two dryer sections of a through-dryer in which the first dryer section is generally at a higher temperature than the second dryer section to improve dryer capacity and inhibit thermal degradation of the web.

A paper web formed according to the present invention can generally be formed from any of a variety of materials known in the art. For example, the paper web can contain pulp fibers either alone or in combination with other types of fibers. Some suitable pulp fibers can include, but are not limited to, softwood fibers, hardwood fibers, secondary fibers obtained from recycled materials, etc. Other fibers can also be added to the paper web if desired. Examples of some suitable fibers can include, but are not limited to, polyolefin fibers, polyester fibers, nylon fibers, polyvinyl acetate fibers, cotton fibers, rayon fibers, non-woody plant fibers, thermomechanical pulp fibers, etc.

In addition, the paper web may also be formed from any papermaking process known in the art. It should be understood that the present invention is not limited to any particular papermaking process. In fact, any process capable of forming a paper web can be utilized in the present invention. For example, a papermaking process of the present invention can utilize creping, embossing, wet-pressing, double creping, calendering, as well as other known steps in forming the paper web.

For example, referring to FIG. 1, one embodiment of a process 10 for forming a paper web is illustrated. As shown, a dilute suspension containing fibers is supplied by a headbox 12 and deposited via a sluice 14 in uniform dispersion onto a foraminous surface 16 of a papermaking machine 18. Once deposited on the foraminous surface 16, water is removed from the web 21 by combinations of gravity, centrifugal force and vacuum suction depending upon the forming configuration. As shown in FIG. 1, a vacuum box 23 can be disposed beneath the web 21 for removing water and facilitating formation of the web.

Once formed, the web 21 can be fed to one or more papermaking devices. For example, as shown in FIG. 1, a hydroneedling device 25 can be provided for hydroneedling a web 21 while on a foraminous surface 16. A vacuum device 29 may be located directly beneath the hydroneedling device 25 or beneath the foraminous surface 16, downstream from hydroneedling device 25, so that excess water can be withdrawn from web 21. Although a hydroneedling device is illustrated and described herein, it should be understood that such a device is not required in the present invention. Moreover, various other well-known papermaking devices may also be utilized in the present invention. Moreover, the web 21 may also be directly transferred to a dryer, such as a through-dryer 30, if desired.

In accordance with the present invention, the web may then be transferred to a dryer to dry the web. For example through-dryers, which utilize non-compressive drying, can be utilized in the present invention. In this regard, one embodiment of a through-dryer that may be used in the present invention will now be described in more detail below. However, it should be understood that the description below relates to only one embodiment of the present invention, and that other embodiments are also intended to be within the scope of the present invention.

Figure 2:
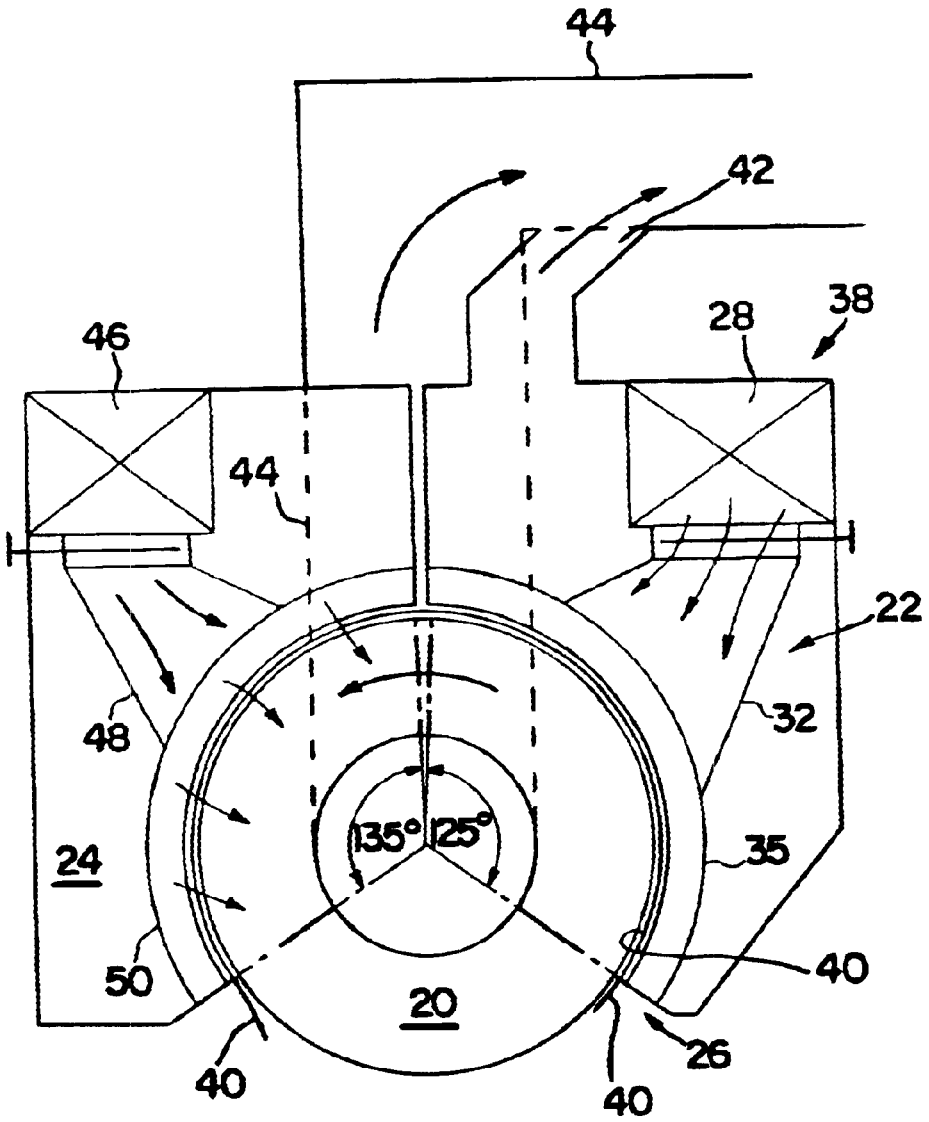
FIG. 2 is a partial cross-sectional view of the through-drying apparatus depicted in FIG. 1 and is a modified version of the apparatus shown in FIG. 1 of U.S. Pat. No. 4,462,868 to Oubridge et al.
Figure 3:
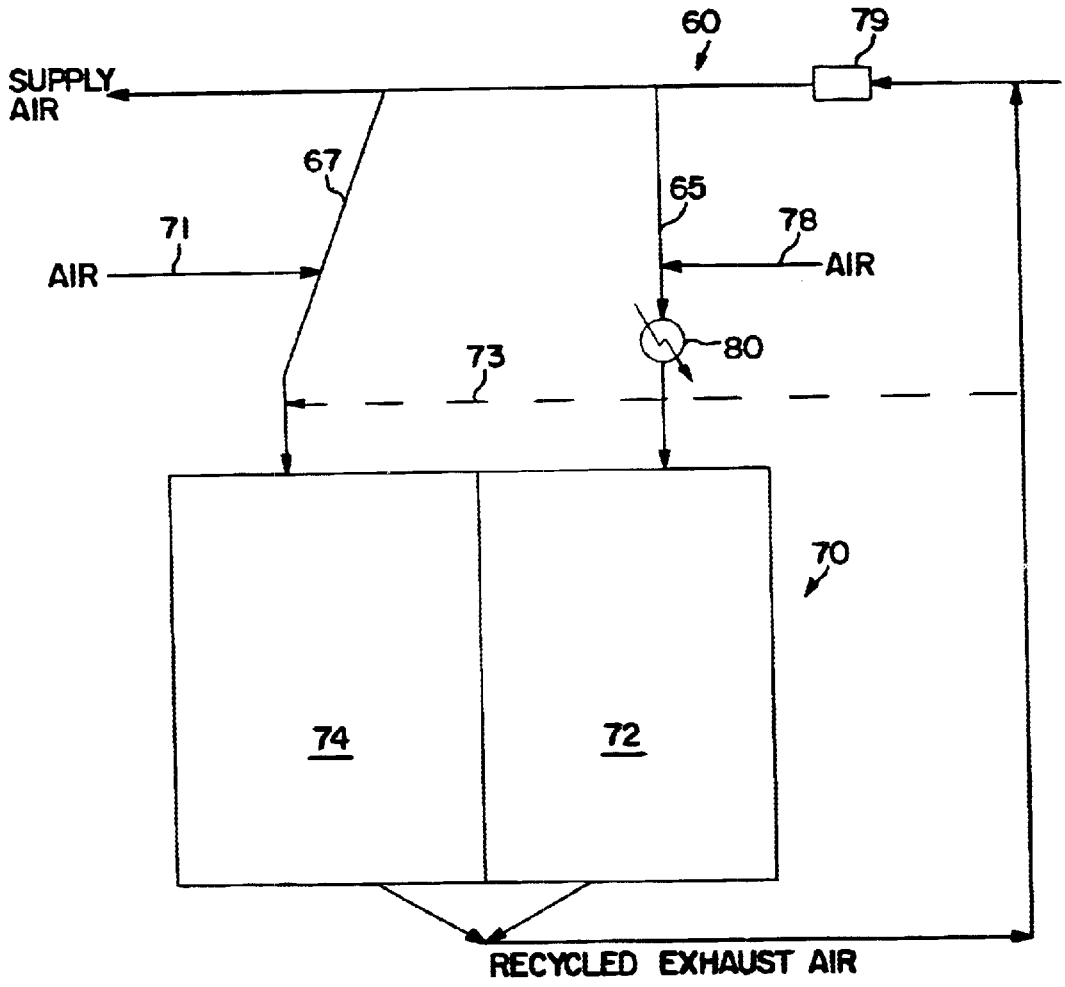
FIG. 3 is a schematic view illustrating one embodiment of the present invention.
Figure 4:
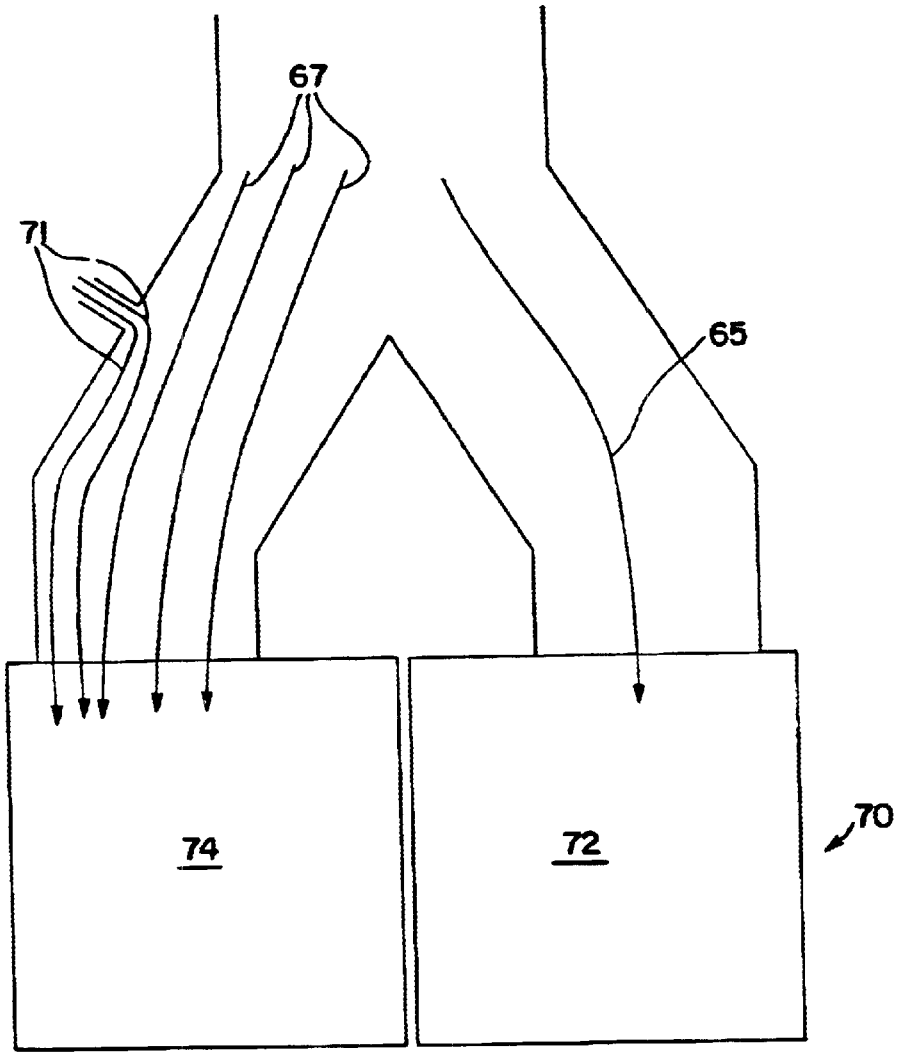
FIG. 4 is a schematic illustration of the introduction of a stream into a through-drying apparatus in accordance with one embodiment of the present invention.

As shown in FIGS. 1–3, the web 21 may be transferred from a foraminous surface 16 to a through-dryer 30 using rolls 27. Through-dryers are generally well known in the art and any of such through-dryers can be utilized in the present invention. For example, some suitable through-dryers are described in U.S. Pat. Nos. 4,462,868 to Oubridge, et al.; 5,465,504 to Joiner; and 5,937,538 to Joiner, which are incorporated herein in their entirety by reference for all purposes. As shown in FIG. 2, the through-dryer 30 contains a rotary through-air drying drum 20 and an outer hood 38. Typically, the drum 20 is hollow so that a gas, such as air or steam, may be exhausted axially therefrom. However, it should be understood that any other gas, such as nitrogen, for example, may also be used in the present invention.

Moreover, it should be understood that the drum 20 may have any desired shape, such as curved, arced, flat, etc.

In some embodiments, the outer hood 38 includes a first dryer section 22 and a second dryer section 24. A relatively wet paper web can be provided on a belt or wire 40 to the first dryer section 22 via an inlet 26. For instance, a web may be supplied to the first dryer section 22 at a consistency of less than about 60%, particularly between about 15% to about 45%, and more particularly between about 20% to about 40%.

As the web is passed around the periphery of the drum 20 within the first dryer section 22, it can be partially dried by a heat source. In general, any of a variety of methods can be utilized to provide heat to the first dryer section 22. For instance, in one embodiment, as shown in FIG. 2, an air heater (not shown) can be provided that is connected to an air channel 28 so that heated air can be selectively fed through a duct 32 to an air distribution header 35 surrounding the periphery of the drum 20. After entering the header 35 from the duct 32, the heated air can then be distributed around the periphery of the drum 20 through a plurality of perforations (not shown) so that the heated air within the header 35 contacts the surface of the web 21.

Within the first dryer section 22, the web is relatively wet so that very little, if any, heated air actually passes through the web. Rather, the air generally impinges on the surface of the web, and heats the web to evaporate the moisture contained thereon. After contacting the web surface, the air can then flow along with the web and/or through the web into the interior of the drum 20, where it can be exhausted. In some embodiments, the drum 20 may also be equipped with a device, such as described in U.S. Pat. No. 4,462,868 to Oubridge, which allows the air to flow back through the perforations (not shown) and out through a return duct 44.

As the drum 20 rotates and the web passes further around beneath the header 35, it can become dryer and more porous, thereby allowing more of the heated air to pass through the web and into the interior of the drum 20 through the return duct 44. After the drum has been rotated a certain amount (e.g., about 125 degrees), the web can become relatively dry and porous so that most or all of the heated air can pass relatively easily through the web. For instance, a relatively dry web may have a consistency of greater than about 25%, particularly greater than about 35%, and more particularly between about 45% to about 70%.

Upon exiting the first dryer section 22, the relatively dry web can then enter the second dryer section 24. As the web is passed around the periphery of the drum 20 within the second dryer section 24, it can be further dried by a heat source. In general, any of a variety of methods can be utilized to provide heat to the second dryer section 24. For instance, in one embodiment, as shown in FIG. 2, an air heater (not shown) can be provided that is connected to an air channel 46 so that heated air can be selectively fed through a duct 48 to an air distribution header 50 surrounding the periphery of the drum 20.

After entering the header 50 from the duct 48, the heated air can then be distributed around the periphery of the drum 20 through a plurality of perforations 36 (See FIG. 1) so that the heated air within the header 50 contacts the surface of the web 21 and passes therethrough. After passing through the web, the air can then flow through the perforations 36 and into the interior of the drum 20, from which air can be exhausted. In some embodiments, after leaving the second dryer section 24, the web can have a consistency of greater than about 90%.

In accordance with the present invention, the temperatures within the first dryer section 22 and the second dryer section 24 can be selectively controlled to improve the overall capacity of the dryer 30. In particular, an elevated temperature can be provided to the first dryer section 22 when the web is relatively wet and a reduced temperature can be provided to the second dryer section 24 when the web is relatively dry. For instance, in one embodiment, a temperature between about 400° F. to about 500° F., and particularly between about 450° F. to about 500° F., is provided to the first dryer section 22, while a temperature between about 300° F. to about 400° F., and particularly between about 300° F. to about 350° F., is provided to the second dryer section 24.

By providing an elevated temperature to the first dryer section 22, it has been discovered that the web can dry at a faster rate, which thereby allows the web to be fed at a greater speed to the dryer to increase the overall rate of production of paper webs (i.e., production capacity). Moreover, it has also been discovered that the provision of such an elevated temperature to only the first dryer section 22 generally does not cause the web to be heated significantly above its "thermal degradation temperature". It should be understood, however, that the web may be heated slightly above the "thermal degradation temperature" for a short period of time without causing a substantial amount of chemical degradation and generation of malodorous compounds due to excess heat. The thermal degradation temperature of a web can vary based on a number of factors, such as the additives utilized and fiber content of the web. For example, a typical wood pulp fiber-based web can have a thermal degradation temperature of about 280° F.

As stated above, when the web is relatively wet, much of the heated air does not pass between the fibers within the web. Instead, the heated air flows parallel to the surface of the web and tends to raise the temperature of the web until it reaches the saturation temperature of the heated air at a given pressure (e.g., about 150° F. at about 1 atmosphere). At the saturation temperature, substantial amounts of moisture contained within the web are evaporated. Accordingly, because the temperature of a relatively wet web is not significantly increased above the saturation temperature of the heated air when dried at an elevated temperature, the temperature of the web within the first through-dryer section 22 typically remains less than the "thermal degradation temperature" of the web.

In general, the temperature supplied to the first dryer section 22 and the second dryer section 24 can be controlled using a variety of methods and/or techniques. For instance, in one embodiment, as shown in FIG. 2, two burners (not shown) can be used in conjunction with two separate air supply channels 28 and 46. In this manner, the temperature of the air supplied to the duct 32 can be controlled independently from the temperature of the air supplied to the duct 48 such that the elevated temperature within the first dryer section 22 is relatively constant and the reduced temperature within the second dryer section 24 is relatively constant. Moreover, if desired, valves can also be provided to adjust air flow across the width of the first through-dryer section 22 and/or the second dryer section 24.

In addition, other techniques may also be utilized. For instance, in one embodiment, as shown in FIG. 3, a supply air stream 60 can be utilized to supply air to a dryer 70. The supply air stream 60 can provide heated air to a first dryer section via an air stream 65 and can provide air to a second dryer section 74 via an air stream 67. In general, the supply air stream 60 can be heated to any desired temperature. In some embodiments, for example, the supply air stream 60 is heated by one or more burners 79 to an elevated temperature and distributed to the first dryer section 72. To provide a reduced temperature to the second dryer section 74, a number of control techniques may be utilized. For example, in some instances, a cooling unit can be provided to cool the air stream 67 to a reduced temperature prior to entering the second dryer section 74.

In another embodiment, one or more streams of air can be combined with the air stream 67 prior to contacting a web within the second dryer section 74. For instance, as shown in FIG. 3, one embodiment of the present invention can utilize a supplemental air stream 71 to reduce the temperature of air entering the second dryer section 74. Moreover, an air stream 73 recycled from the exhaust of the first dryer section 72 and/or the second dryer section 74 can also be used to reduce the temperature of air entering the second dryer section 74.

Figure 5:
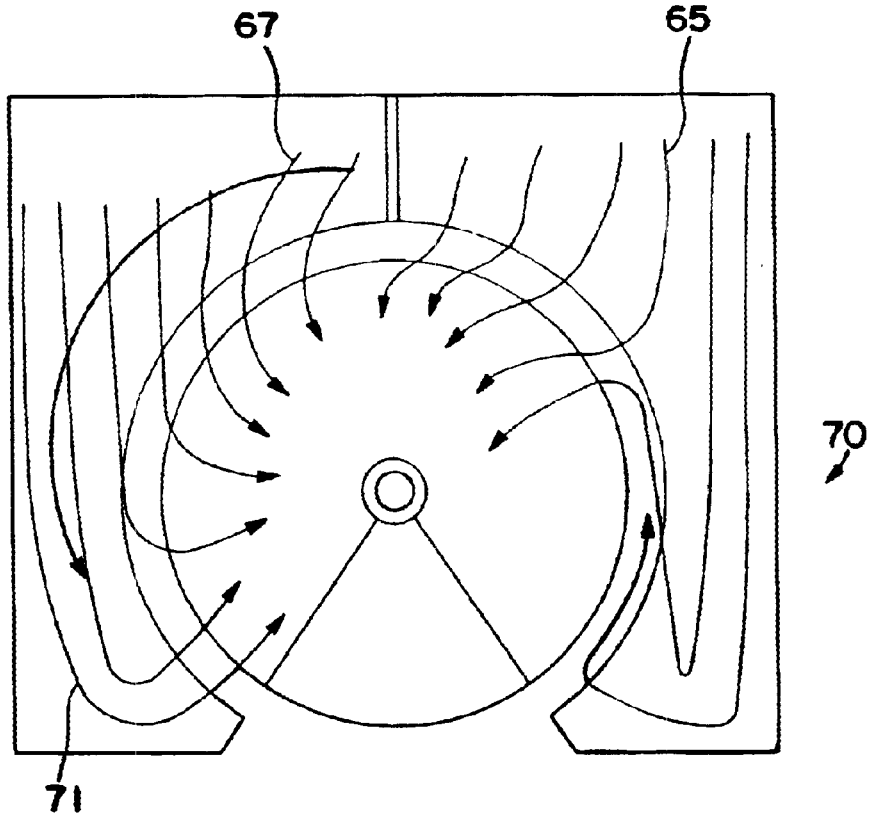
FIG. 5 is a partial cross-sectional view of the through-drying apparatus schematically illustrated in FIG. 4.

In these embodiments, the reduced temperature provided by the combination of the streams 73 and/or 71 with the stream 67 can actually vary at different points within the second dryer section 74. For example, a stream 73 of air can be combined with the air stream 67 within the second dryer section 74 or a duct (not shown) such that the temperature of the web decreases as it moves through the second dryer section 74. In one embodiment, for example, the flow of the air stream 67 can create a negative pressure across an induction system that causes the streams 73 and/or 71 to be drawn into the air stream 67 without the use of fans, etc. Thus, due to the flow dynamics of these streams, as shown in FIG. 5, the cooler air stream 65 can be drawn toward the bottom end of section 74, while the warmer air stream 67 can remain at the top end of section 74. As a result, a web entering the section 74 can be initially heated by the warmer stream 67. As the web exits the section 74, however, it can be heated to a somewhat lower temperature by the stream 71. Such a temperature profile can further enhance the capacity of the dryer 70.

Although the embodiment described and shown herein relates to induction without a fan, it should be understood that fans, vanes, and other control devices may be utilized in accordance with the present invention to further control the temperature profile within the section 74. In some embodiments, such control devices may be particularly useful in obtaining the desired temperature profile within the section 74.

Moreover, as shown in FIG. 3, heating mechanisms, such as, but not limited to, burners and/or supplemental air streams, can also be provided, in some embodiments, to control the temperature of air within the first dryer section 72. For instance, in one embodiment, the air stream 65 is heated by one or more burners 79 to a reduced temperature and distributed to the second dryer section 74. To provide air at an elevated temperature to the first dryer section 72, an additional heater 80 can be provided, in some embodiments, to heat the air stream 65 within a duct (not shown) or within the first dryer section 72.

In another embodiment, one or more streams of air can be combined with the air stream 65 prior to contacting a web within the first dryer section 72. For instance, as shown in FIG. 3, one embodiment of the present invention can utilize a supplemental heated air stream 78. As described above, the elevated temperature provided by the combination of the stream 78 with the stream 65 can actually vary at different points within the first dryer section 72. For example, a stream 78 of warmer air can be combined with the cooler air stream 65 within the first dryer section 72 or a duct (not shown) such that the temperature of the web decreases as it moves through the first dryer section 72. In one embodiment, for example, the flow of the air stream 65 can create a negative pressure across an induction system that causes the stream 78 to be drawn into the air stream 67 without the use of fans, etc. Thus, due to the flow dynamics of these streams, such as described above, the cooler air stream 65 can remain at the top end of the section 72, while the warmer air stream 78 can be drawn toward the bottom end of the section 72. As a result, a web entering the section 72 can be initially heated by the warmer stream 78. As the web exits the section 72, however, it can be heated to a somewhat lower temperature by the stream 65. Such a temperature profile can further enhance the capacity of the dryer 70.

Although the embodiment described and shown herein relates to induction without a fan, it should be understood that fans, vanes, and other control devices may be utilized in accordance with the present invention to further control the temperature profile within the section 72. In some embodiments, such control devices may be particularly useful in obtaining the desired temperature profile within the section 72.

The temperature, flow rate, and location of the streams of air can generally be controlled to provide any desired temperature profile for drying the web. It should be understood that any of the above-mentioned techniques, as well as other techniques, can be used alone or in combination. Moreover, it should also be understood that additional streams of air or other cooling fluids may be utilized if desired.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method for drying a paper web comprising:

providing a through-dryer having a first dryer section and a second dryer section;

drying a relatively wet paper web having a solids consistency between about 20% to about 40% within said first dryer section at an elevated temperature to form a relatively dry paper web without significantly increasing the temperature of the paper web above the thermal degradation temperature of the paper web; and subsequently drying the relatively dry paper web within said second dryer section at a reduced temperature in comparison to said elevated temperature.

2. A method as defined in claim 1, wherein said relatively dry paper web has a solids consistency between about 45% to about 70%.

3. A method as defined in claim 1, wherein said elevated temperature is relatively constant within said first dryer section.

4. A method as defined in claim 1, wherein said reduced temperature is relatively constant within said second dryer section.

5. A method as defined in claim 1, wherein said elevated temperature decreases within said first dryer section.

6. A method as defined in claim 1, wherein said reduced temperature decreases within said second dryer section.

7. A method as defined in claim 1, wherein said elevated temperature ranges from about 400° F. to about 500° F. and said reduced temperature ranges from about 300° F. to about 400° F.

8. A method as defined in claim 7, wherein said elevated temperature ranges from about 450° F. to about 500° F.

9. A method as defined in claim 7, wherein said reduced temperature ranges from about 300° F. to about 350° F.

10. A method for drying a paper web comprising:

providing a dryer having a first dryer section and a second dryer section;

drying a relatively wet paper web having an initial solids consistency of between about 20% to about 40% within said first dryer section at an elevated temperature to form a relatively dry paper web without significantly increasing the temperature of the paper web above the thermal degradation temperature of the paper web, wherein said relatively dry paper has a solids consistency between about 45% to about 70%; and subsequently drying the relatively dry paper web within said second dryer section at a reduced temperature in comparison to said elevated temperature.

11. A method as defined in claim 10, wherein said dryer is a through-dryer.

12. A method as defined in claim 10, wherein said elevated temperature is relatively constant within said first dryer section.

13. A method as defined in claim 10, wherein said reduced temperature is relatively constant within said second dryer section.

14. A method as defined in claim 10, wherein said elevated temperature decreases within said first dryer section.

15. A method as defined in claim 10, wherein said reduced temperature decreases within said second dryer section.

16. A method as defined in claim 10, wherein said elevated temperature ranges from about 400° F. to about 500° F. and said reduced temperature ranges from about 300° F. to about 400° F.

17. A method as defined in claim 16, wherein said elevated temperature ranges from about 450° F. to about 500° F.

18. A method as defined in claim 16, wherein said reduced temperature ranges from about 300° F. to about 350° F.

19. A method for drying a paper web comprising:

providing a through-dryer having a first dryer section and a second dryer section;

drying the paper web having an initial solids consistently less than about 60% within said first dryer section at an elevated temperature ranging from about 400° F. to about 500° F. to form a paper web having a solids consistently greater than about 25% without significantly increasing the temperature of the paper web above the thermal degradation temperature of the paper web; and subsequently drying the paper web having a solids consistently greater than about 25% within said second dryer section at a reduced temperature ranging from about 300° F. to about 400° F.

20. A method as defined in claim 19, wherein said elevated temperature ranges from about 450° F. to about 500° F.

21. A method as defined in claim 19, wherein said reduced temperature ranges from about 300° F. to about 350° F.

22. A method as defined in claim 19, wherein said paper web dried within said first dryer section has an initial solids consistency between about 15% to about 45%.

23. A method as defined in claim 19, wherein said paper web dried within said first dryer section has an initial solids consistency between about 20% to about 40%.

24. A method as defined in claim 19, wherein said paper web is dried to a solids consistency greater than about 35% within said first dryer section.

25. A method as defined in claim 19, wherein said paper web is dried to a solids consistency between about 45% to about 70% within said first dryer section.

26. A method as defined in claim 19, wherein said elevated temperature decreases within said first dryer section.

27. A method as defined in claim 19, wherein said reduced temperature decreases within said second dryer section.

28. A method as defined in claim 19, wherein said elevated temperature decreases within said first dryer section.

29. A method as defined in claim 19, wherein said reduced temperature decreases within said second dryer section.

30. A method for drying a paper web comprising:

providing a dryer having a first dryer section and a second dryer section;

drying a relatively wet paper web within said first dryer section at an elevated temperature to form a relatively dry paper web without significantly increasing the temperature of the paper web above the thermal degradation temperature of the paper web; and subsequently drying the relatively dry paper web within said second dryer section at a reduced temperature in comparison to said elevated temperature, wherein said elevated temperature ranges from about 400° F. to about 500° F. and said reduced temperature ranges from about 300° F. to about 400° F.

31. A method as defined in claim 30, wherein said dryer is a through-dryer.

32. A method as defined in claim 30, wherein said relatively wet paper web has a solids consistency between about 20% to about 40%.

33. A method as defined in claim 30, wherein said relatively dry paper web has a solids consistency between about 45% to about 70%.

34. A method as defined in claim 30, wherein said elevated temperature is relatively constant within said first dryer section.

35. A method as defined in claim 30, wherein said reduced temperature is relatively constant within said second dryer section.

36. A method as defined in claim 30, wherein said elevated temperature decreases within said first dryer section.

37. A method as defined in claim 30, wherein said reduced temperature decreases within said second dryer section.

38. A method as defined in claim 30, wherein said elevated temperature ranges from about 450° F. to about 500° F.

39. A method as defined in claim 30, wherein said reduced temperature ranges from about 300° F. to about 350° F.

* * * * *

UNITED STATES PATENT AND TRADEMARK OFFICE

CERTIFICATE OF CORRECTION

PATENT NO. : 6,631,566 B2
APPLICATION NO. : 09/954487
DATED : October 14, 2003
INVENTOR(S) : Russell F. Ross and Jack C. Lau It is certified that error appears in the above-identified patent and that said Letters Patent is hereby corrected as shown below:

Column 9, lines 49, 53, 57: “consistently” should be --“consistency”--

Signed and Sealed this

Thirtieth Day of January, 2007

JON W. DUDAS
*Director of the United States Patent and Trademark Office*